US007253598B1

(12) United States Patent
Doyle et al.

(10) Patent No.: US 7,253,598 B1
(45) Date of Patent: Aug. 7, 2007

(54) BANDGAP REFERENCE DESIGNS WITH STACKED DIODES, INTEGRATED CURRENT SOURCE AND INTEGRATED SUB-BANDGAP REFERENCE

(75) Inventors: James T. Doyle, Nederland, CO (US); Dae Woon Kang, Boulder, CO (US); Martin Dermody, Boulder, CO (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 11/129,969

(22) Filed: May 16, 2005

(51) Int. Cl.
*G05F 1/16* (2006.01)

(52) U.S. Cl. ..... 323/316; 323/314; 327/539

(58) Field of Classification Search ..... 323/312, 323/313, 314, 315, 316; 327/538, 539, 540
See application file for complete search history.

(56) References Cited

U.S. PATENT DOCUMENTS 6,052,020 A * 4/2000 Doyle ..... 323/316
6,075,407 A 6/2000 Doyle
6,281,743 B1 * 8/2001 Doyle ..... 323/315
6,462,612 B1 * 10/2002 Roh et al. ..... 327/539
6,507,179 B1 * 1/2003 Jun et al. ..... 323/313

* cited by examiner

*Primary Examiner*—Jessica Han

(57) ABSTRACT

The performance of a bandgap reference circuit is improved by increasing the ΔVBE, and thereby correspondingly decreasing the input sensitivity of the error amplifier in the control loop. The ΔVBE can be increased by presenting stacked diode configurations at the amplifier inputs, by increasing the diode ratio presented at the amplifier inputs, and by providing a higher current in the CTAT leg than in the PTAT leg. The stacked diode configuration is achieved by producing isolated diodes with a triple well CMOS process. The stacked diode configuration and the triple well CMOS process also permit the input stage of the amplifier to use N-channel transistors operating in the threshold region.

21 Claims, 3 Drawing Sheets

BANDGAP REFERENCE DESIGNS WITH STACKED DIODES, INTEGRATED CURRENT SOURCE AND INTEGRATED SUB-BANDGAP REFERENCE

TECHNICAL FIELD OF THE INVENTION

The invention relates generally to electronic circuitry and, more particularly, to bandgap reference circuits that produce reference voltages for use by electronic circuitry.

BACKGROUND OF THE INVENTION

Virtually all systems that manipulate analog, digital or mixed signals utilize at least one reference voltage as a basis for other operations in the system. The reference voltage should be reproducible every time the circuit is powered up, and must remain relatively unchanged over process, voltage and temperature (PVT) variations. A well known conventional technique for producing a reference voltage is the semiconductor bandgap reference circuit, also referred to as a bandgap reference. A bandgap reference circuit relies on the bandgap energy of the underlying semiconductor material. Such bandgap reference circuits are well known in the art. Conventional examples of such bandgap reference circuits can be found, for example, in U.S. Pat. Nos. 6,075,407 and 6,281,743, both of which are incorporated herein by reference.

In addition to the aforementioned requirement that bandgap reference circuits provide adequate performance over PVT variations, many applications also require the bandgap reference circuit to operate at vary low supply currents, and to be as small as possible.

One factor that can significantly impact the performance of a bandgap reference circuit is the input offset of the control loop amplifier (error amplifier). The offset is typically multiplied by approximately 10 in most bandgap designs. This multiplication factor can translate a relatively small offset error at the amplifier input into a relatively large error at the amplifier output. Trimming can provide a limited solution to the offset problem, but usually only at a single nominal temperature, not across the entire operating temperature range. Choppers have is also been conventionally utilized to solve offset problems, but they are not particularly effective in some applications, for example, low drop out amplifiers (LDOs) and switched power supplies.

It is desirable in view of the foregoing to provide bandgap reference circuit designs which provide adequate performance over PVT variations, operate at low currents, produce a relatively compact circuit footprint, and overcome offset problems.

SUMMARY OF THE INVENTION

Exemplary embodiments of the invention improve bandgap reference circuit performance by increasing ΔVBE, and thereby correspondingly decreasing the input sensitivity of the error amplifier in the control loop. Some embodiments increase ΔVBE by presenting stacked diode configurations at the amplifier inputs, other embodiments increase ΔVBE by increasing the diode ratio presented at the amplifier inputs, and other embodiments increase ΔVBE by providing a higher current in the CTAT leg than in the PTAT leg. The stacked diode configuration is achieved by producing isolated diodes with a triple well CMOS process. The stacked diode configuration and the triple well CMOS process also permit some embodiments to utilize in the input stage of the amplifier N-channel transistors operating in the threshold region.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation. A controller may be implemented in hardware, firmware or software, or some combination of at least two of the same. It should be noted that the functionality associated with a controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention and its advantages, reference is now made to the following description taken in conjunction with the accompanying drawings, in which like reference numerals represent like parts.

DETAILED DESCRIPTION OF THE INVENTION

FIGS. 1 through 6, discussed herein, and the various embodiments used to describe the principles of the present invention in this patent document are by way of illustration only and should not be construed in any way to limit the scope of the invention. Those skilled in the art will understand that the principles of the present invention may be implemented in any suitably arranged system.

The drop across the resistor in the PTAT (proportional to absolute temperature) leg of a conventional bandgap reference circuit is commonly referenced to as ΔVBE, because it represents the difference between the voltage drops (base-emitter voltages) of the respective diode structures in the PTAT and CTAT (complementary to absolute temperature) legs of the circuit. In a typical conventional bandgap circuit, ΔVBE is around 50 millivolts. The sum of the multiplied ΔVBE and the diode potential (about 0.6 volts) must be equal to approximately 1.22 volts, the bandgap voltage. Accordingly, the error amplifier must typically introduce a ΔVBE multiplication factor of 10 in order to produce the desired bandgap voltage. As mentioned above, however, this 10× multiplication can turn a relatively small offset error at the amplifier input into a relatively large error at the amplifier output. Exemplary embodiments of the invention make the initial ΔVBE larger, thereby permitting a corresponding reduction in the multiplication factor applied by the error amplifier. This reduces the impact of offset errors that occur at the amplifier input.

One direct way to increase the ΔVBE of a conventional bandgap reference circuit is to replace every diode in both the CTAT and PTAT legs with two series-connected diodes. The use of two series-connected diodes in place of a single diode is also referred to herein as diode stacking, or a stacked diode configuration. This use of stacked diode arrangements in the CTAT and PTAT legs doubles the voltage drops across the respective diode structures in the CTAT and PTAT legs, which in turn doubles the ΔVBE of the circuit. As indicated above, such an increase in ΔVBE reduces the sensitivity of the amplifier to input offset errors.

However, it is not possible to produce completely isolated diodes in a conventional bulk CMOS process. Accordingly, it would be impractical at best to attempt to produce a stacked diode configuration of the type described above using a bulk CMOS process. The present invention recognizes that isolated diode structures can be produced using a conventional triple well CMOS process. This is illustrated generally in FIGS. 1 and 2.

Figure 1:
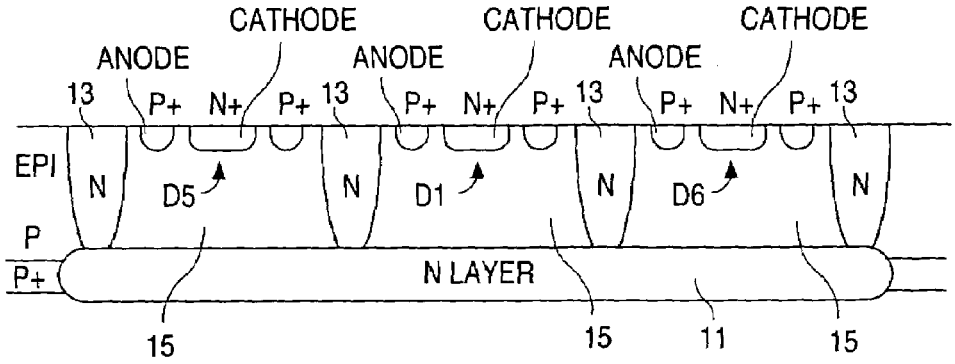
FIG. 1 diagrammatically illustrates an array of isolated diodes in a triple well CMOS process.
Figure 2:
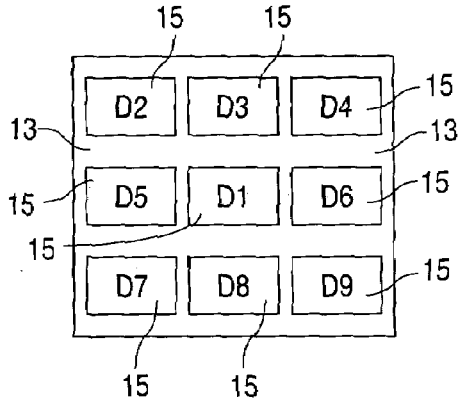
FIG. 2 is a top view of FIG. 1.

Referring to FIG. 1, the triple well CMOS process is characterized by a buried N layer (or deep N well) 11. Standard N wells 13 diffuse deep enough into the EPI to contact the buried N layer. This creates isolated P regions 15, in which isolated diodes D1, D5 and D6 can be produced. As can be seen from FIG. 1, these isolated diode structures can easily be connected in series to form the type of stacked configuration described above. FIG. 2 is merely a top view of the structure in FIG. 1, illustrating how an exemplary array of nine diodes D1–D9 can be provided in respective isolated P regions in a 3×3 configuration (a so-called "magic square"). The diodes formed in the P regions 15 are isolated from one another by cooperation of a plurality of mutually contacting N wells 13, together with the buried N layer 11 (not visible in FIG. 2).

Figure 3:
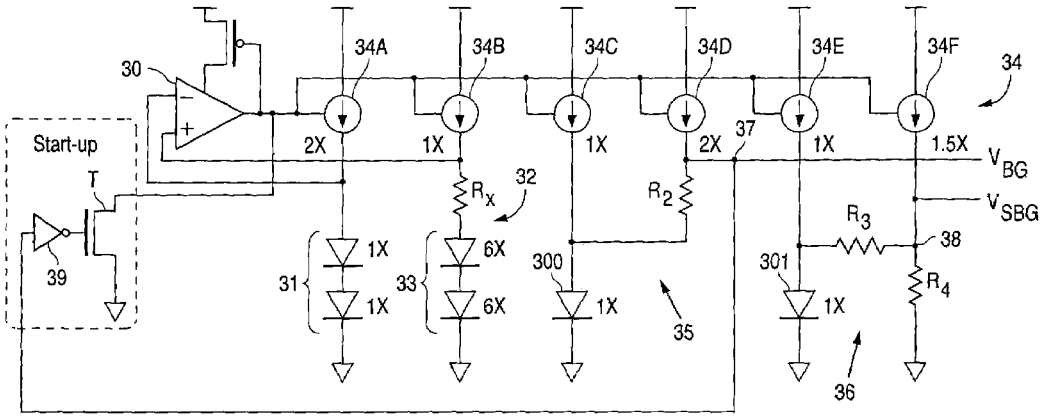
FIG. 3 diagrammatically illustrates a bandgap reference circuit according to exemplary embodiments of the invention.

FIG. 3 diagrammatically illustrates a bandgap reference circuit that utilizes stacked diodes to increase ΔVBE according to exemplary embodiments of the invention. The bandgap reference circuit of FIG. 3 includes an error amplifier 30 having an inverting input connected to a CTAT leg 31, and having a non-inverting input connected to a PTAT leg 32. The amplifier 30 has an output connected to a control input of a current source arrangement 34. The current source arrangement 34 includes a plurality of current sources 34A–34F (e.g. a plurality of current mirrors), all of which have a common control input driven by the output of the amplifier 30. The current source 34A supplies current to the CTAT leg 31, and the current source 34B supplies current to the PTAT leg 32. The current sources 34C and 34D supply current to a bandgap portion 35 which produces the desired bandgap voltage $V_{BG}$ at node 37. The current sources 34E and 34F provide current to a sub-bandgap portion 36 which produces a sub-bandgap voltage $V_{SBG}$ at node 38.

The current source structure 34 provides a replicated mirrored topology for isolating the bandgap portion 35 and sub-bandgap portion 36 from the CTAT and PTAT legs 31 and 32. The bandgap portion 35, sub-bandgap portion 36, and current source structure 34 all share the common amplifier 30. This provides a more compact and integrated structure than the prior art, wherein each of the current source, bandgap portion and sub-bandgap portion requires its own dedicated amplifier.

The CTAT leg 31 includes a pair of diodes connected in series, or stacked, between the inverting input of amplifier 30 and a ground reference potential. The PTAT leg 32 includes a resistor $R_X$ connected in series with a diode arrangement 33 between the non-inverting input of amplifier 30 and the ground reference potential. In the example of FIG. 3, the diode arrangement 33 has a stacked configuration, and represents six of the CTAT legs 31 connected as parallel branches in parallel with one another between the resistor $R_X$ and the ground reference potential. As mentioned above, the use of stacked diode configurations doubles ΔVBE, which reduces the input sensitivity of the amplifier 30 by a factor of 2.

In some embodiments, the current source 34A mirrors into the CTAT leg 31 twice as much current as the current source 34B mirrors into the PTAT leg 32. This effectively doubles the ratio of the diode area in PTAT leg 32 to the diode area in CTAT leg 31. So doubling the current in the CTAT 31 changes the diode ratio between the 2 legs from 6:1 to 12:1. This further increases ΔVBE and further correspondingly decreases the effect of offset errors at the amplifier input.

In some embodiments, the resistance $R_X$ provides a resistance value that is substantially constant (flat temperature coefficient) over the operating temperature range. This can be accomplished, for example, by a series combination of two separate resistors having approximately equal resistance values, with one of the separate resistances having a positive temperature coefficient and the other separate resistance having a complementary negative temperature coefficient. For example, one of the separate resistances can be an N-well resistor, and the other of the separate resistances can be a poly resistor. Because the resistance value of $R_X$ remains substantially constant over temperature, and because ΔVBE has a PTAT characteristic, the amplifier 30 and the current source structure 34 will cooperate to produce a PTAT current through the resistance $R_X$ of the PTAT leg 32. This means that all currents produced by the current source structure 34 under control of the amplifier 30 will be PTAT currents. Note also that a PTAT current flowing through a CTAT device such as a diode will have only a negligible impact on the CTAT characteristic of the diode.

In the bandgap portion 35, the bandgap voltage 37 is realized by passing PTAT current from the current source arrangement 34 through a diode 300. As indicated above, the diode 300 will exhibit a CTAT characteristic. The voltage across the diode (0.6 volt drop) is summed with the voltage across the resistance $R_2$ to produce the bandgap voltage at 37. In some embodiments, $R_2$ is produced in the same manner as $R_X$ to exhibit a flat temperature coefficient. The value of the resistance $R_2$ is selected to give a 0.6 volt drop when driven with the PTAT current from the current source 34D. In some embodiments, the current source 34D mirrors the same current provided by the current source 34A, and the current source 34C mirrors the same current provided by the current source 34B. The voltage drop across resistance $R_2$ is a PTAT voltage because a PTAT current flows through a flat temperature coefficient resistance. Accordingly, the CTAT voltage characteristic of the diode 300 is combined with the PTAT voltage characteristic of the resistance $R_2$, thereby producing the desired bandgap reference voltage at 37.

In the sub-bandgap portion 36, a resistor divider is connected to divide the voltage drop across a diode 301. The resistances $R_3$ and $R_4$ of the resistor divider are flat temperature coefficient resistances (which in some embodiments are constructed in the same manner described above with respect to $R_X$). The resistance $R_3$ effectively interconnects a CTAT leg (diode 301) with a PTAT leg (resistance $R_4$), thereby providing at 38 the desired combination of CTAT and PTAT characteristics at a sub-bandgap voltage level, for example 0.5 volts. In some embodiments, the current source 34E mirrors the same current provided by current sources 34B and 34C, and the current source 34F provides 1.5 times as much current as the current source 34E.

The bandgap reference circuit of FIG. 3 is also provided with a startup circuit including an inverter 39 with an output connected to the gate of an N-channel transistor T whose drain is connected to the output of the amplifier 30. The input of inverter 39 is connected to the bandgap voltage at 37. At power up, the bandgap voltage is zero so the inverter 39 drives the gate of transistor T high, and the transistor T pulls an initial current trickle from the control inputs of the current mirrors at 34A–34F. In some embodiments, the current mirrors at 34A–34F are implemented as respective P-channel transistors, and the transistor T draws current from the gates of those P-channel transistors. This current draw turns on the current mirrors and thereby starts the operation of the bandgap reference circuit.

The stacked diode arrangements at 31 and 33 also guarantee that the voltages at the amplifier inputs will exceed the threshold of an N-channel transistor. It is therefore possible to use N-channel transistors in the input stage of the amplifier 30, and to operate those N-channel transistors in the threshold region. Conventional bandgap reference circuits do not permit operation of N-channel input transistors in the threshold region. N-channel devices are generally preferable to P-channel devices in the amplifier input stage for numerous reasons, including superior transconductance, superior gain, and smaller size. However, in a conventional bulk CMOS process, the bulk contacts of all N-channel devices are defined by the substrate, and are therefore effectively tied together. Accordingly, the N-channel transistors cannot be isolated from one another, and the bulk contact of a given N-channel transistor cannot be connected to the source of that transistor. The offset error of the amplifier is increased dramatically if the bulk contact of an input stage transistor cannot be tied to its source.

Figure 4:
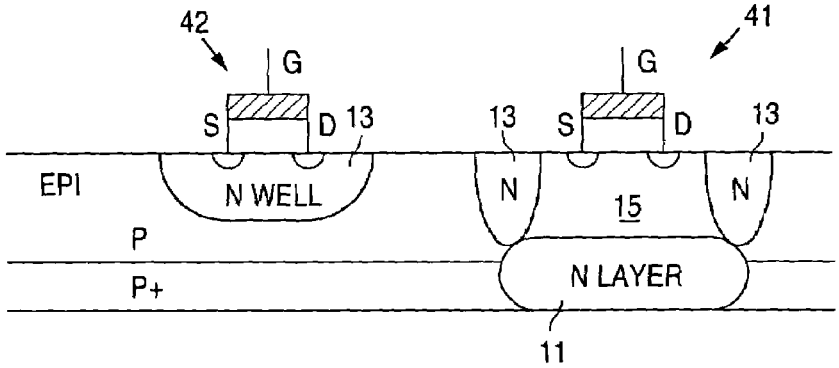
FIG. 4 diagrammatically illustrates an isolated N-channel transistor in a triple well CMOS process.

However, and referring now to FIG. 4, the isolated P regions 15 described above with respect to FIG. 1 can also be utilized to produce isolated N-channel transistors such as illustrated at 41. This isolation of the N-channel transistor 41 permits the desired bulk-to-source connection to be made with respect to any N-channel transistor 41. Also shown in FIG. 4 is the conventional P-channel transistor 42 isolated in an N-well 13.

Figure 5:
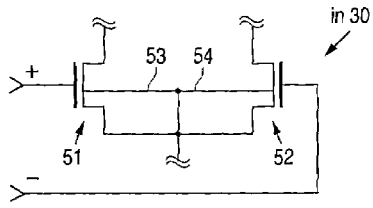
FIG. 5 diagrammatically illustrates pertinent portions of the input stage of the error amplifier of FIG. 3 according to exemplary embodiments of the invention.

Accordingly, using a conventional triple well CMOS process and stacked diode configurations in the CTAT and PTAT legs 31 and 32, the input stage of the amplifier 30 of FIG. 3 can be realized using N-channel transistors operating in the threshold region, and without adversely affecting the offset error of the amplifier. FIG. 5 diagrammatically illustrates pertinent portions of the input stage of the error amplifier 30 according to exemplary embodiments of the invention wherein the N-channel transistors 51 and 52 are produced using a triple well CMOS process in order to permit the desired bulk-to-source connections at 53 and 54. The circuit details of the remainder of the error amplifier 30 are not necessary to understand the invention, and are well understood by the workers in the art. Accordingly, these details have been omitted for purposes of clarity.

Figure 6:
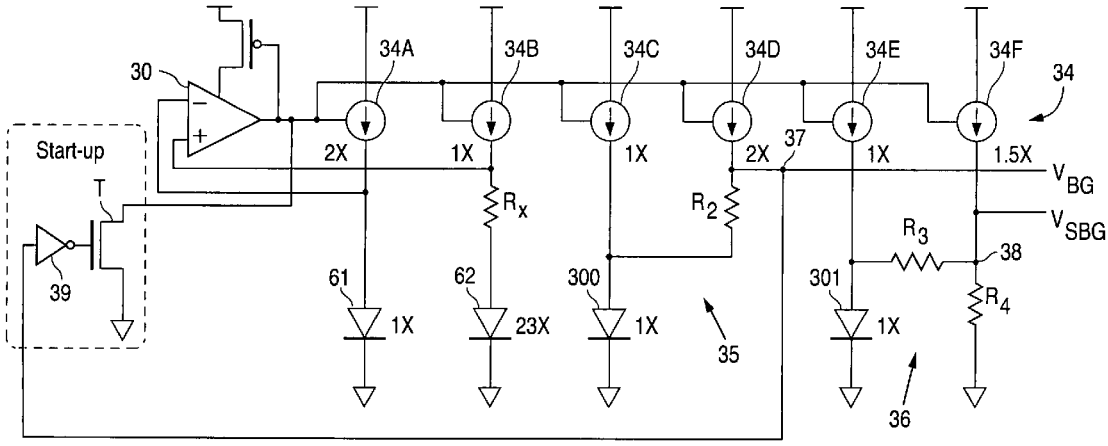
FIG. 6 diagrammatically illustrates a bandgap reference circuit according to further exemplary embodiments of the invention.

FIG. 6 diagrammatically illustrates a bandgap reference circuit according to further exemplary embodiments of the invention. The bandgap reference circuit of FIG. 6 has a topography generally similar to that of FIG. 3, but does not utilize the stacked diode arrangement of FIG. 3. Rather, the CTAT leg of FIG. 6 utilizes a single diode 61, and the PTAT leg of FIG. 6 utilizes 23 of the diodes 61 connected in parallel with one another between the resistance $R_X$ and the ground reference potential. This parallel combination of 23 diodes 61 is illustrated generally at 62. By providing a 23:1 diode ratio between the PTAT and CTAT legs, as compared to a typical conventional 8:1 ratio, the bandgap reference circuit of FIG. 6 provides an increased ΔVBE. In some embodiments, the CTAT leg receives twice as much current as the PTAT leg, thereby further increasing the effective diode ratio and further correspondingly increasing ΔVBE. The bandgap reference circuit of FIG. 6 does not support the use of N-channel input transistors operating in the threshold region in amplifier 30. However, P-channel transistors can be utilized in the input stage of amplifier 30.

Although the present invention has been described with exemplary embodiments, various changes and modifications may be suggested to one skilled in the art. It is intended that the present invention encompass such changes and modifications as fall within the scope of the appended claims.

What is claimed is:

1. A bandgap reference circuit, comprising:

a first leg having a first diode structure;

a second leg having a second diode structure in series with a resistor, said second diode structure having a larger diode area than said first diode structure;

an amplifier having a pair of inputs and an output, the inputs respectively coupled to said first and second legs;

a current source structure having a control input coupled to said amplifier output and having first and second current source outputs respectively coupled to said first and second legs;

a bandgap portion for producing a bandgap voltage, said current source structure having a third current source output coupled to said bandgap portion; and a sub-bandgap portion for producing a sub-bandgap voltage which is lower than said bandgap voltage, said current source structure having a fourth current source output coupled to said sub-bandgap portion.

2. The circuit of claim 1, wherein said first diode structure includes two diodes connected in series with one another, and said second diode structure includes a plurality of diode branches connected in parallel with one another, each said diode branch including two series-connected diodes.

3. The circuit of claim 2, wherein all of said diodes are produced using a triple well CMOS process.

4. The circuit of claim 3, wherein said amplifier includes first and second N-channel transistors respectively connected to said amplifier inputs, each of said N-channel transistors produced using said triple well CMOS process, and each of said N-channel transistors having a bulk thereof connected to a source thereof.

5. The circuit of claim 2, wherein said amplifier includes first and second N-channel transistors respectively connected to said amplifier inputs, each of said N-channel transistors produced using a triple well CMOS process, and each of said N-channel transistors having a bulk thereof connected to a source thereof.

6. The circuit of claim 2, wherein said first current source output supplies a first amount of current to said first leg and said second current source output supplies a second amount of current to said second leg, said first amount of current at least approximately twice as large as said second amount of current.

7. The circuit of claim 1, wherein said first current source output supplies a first amount of current to said first leg and said second current source output supplies a second amount of current to said second leg, said first amount of current at least approximately twice as large as said second amount of current.

8. The circuit of claim 1, including a startup circuit coupled between said bandgap portion and said control input of said current source structure for starting operation of said bandgap reference circuit.

9. The circuit of claim 8, wherein said startup circuit includes:

an inverter having an input coupled to a node of said bandgap portion that produces said bandgap voltage; and an N-channel transistor with a gate that is coupled to an output of said inverter and a drain that is coupled to said control input of said current source structure.

10. The circuit of claim 1, wherein said resistor has a resistance value that remains substantially constant with respect to temperature variations, and wherein said current source outputs of said current source structure supply respective proportional to absolute temperature (PTAT) currents.

11. A bandgap reference circuit, comprising:

a first leg including two series-connected diodes;

a second leg including a resistor connected in series with a plurality of diode branches that are connected in parallel with one another, each said diode branch including two series-connected diodes;

an amplifier having a pair of inputs and an output, the input respectively coupled to said first and second legs; and a current source structure having a control input coupled to said amplifier output and having first and second current source outputs respectively coupled to said first and second legs.

12. The circuit of claim 11, wherein each of said diodes is produced using a triple well CMOS process.

13. The circuit of claim 12, wherein said amplifier includes first and second N-channel transistors respectively connected to said amplifier inputs, each of said N-channel transistors produced using said triple well CMOS process, and each of said N-channel transistors having a bulk thereof connected to a source thereof.

14. The circuit of claim 11, wherein said amplifier includes first and second N-channel transistors respectively connected to said amplifier inputs, each of said N-channel transistors produced using a triple well CMOS process, and each of said N-channel transistors having a bulk thereof connected to a source thereof.

15. The circuit of claim 11, wherein said first current source output supplies a first amount of current to said first leg and said second current source output supplies a second amount of current to said second leg, said first amount of current at least approximately twice as large as said second amount of current.

16. The circuit of claim 11, wherein said resistor has a resistance value that remains substantially constant with respect to temperature variations, and wherein said first and second current source outputs supply respective proportional to absolute temperature (PTAT) currents.

17. A bandgap reference circuit, comprising:

a first leg having a first diode structure;

a second leg having a second diode structure in series with a resistor, said second diode structure having a larger diode area than said first diode structure;

an amplifier having a pair of inputs and an output, the inputs respectively coupled to said first and second legs; and a current source structure having a control input coupled to said amplifier output and having first and second current source outputs respectively coupled to said first and second legs;

wherein said first current source output provides a first amount of current to said first leg and said second current source output provides a second amount of current to said second leg, said first amount of current at least approximately twice as large as said second amount of current; and wherein said amplifier includes first and second N-channel transistors respectively connected to said amplifier inputs, each of said N-channel transistors produced using a triple well CMOS process, and each of said N-channel transistors having a bulk thereof connected to a source thereof.

18. The circuit of claim 17, wherein said resistor has a resistance value that remains substantially constant with respect to temperature variations, and wherein said first and second current source outputs supply respective proportional to absolute temperature (PTAT) currents.

19. The circuit of claim 17, wherein:

said first diode structure includes multiple diodes connected in series; and said second diode structure includes multiple diode branches connected in parallel with one another, each diode branch including multiple series-connected diodes.

20. The circuit of claim 17, wherein diodes in the first and second diode structures are produced using the triple well CMOS process.

21. A bandgap reference circuit, comprising:

a first leg having a first diode structure;

a second leg having a second diode structure in series with a resistor, the second diode structure having a larger diode area than the first diode structure;

an amplifier having a pair of inputs and an output, the inputs respectively coupled to the first and second legs; and a current source structure having a control input coupled to the amplifier output and having first and second current source outputs respectively coupled to the first and second legs;

wherein the amplifier includes first and second N-channel transistors respectively connected to the amplifier inputs, each of the N-channel transistors produced using a triple well CMOS process, each of the N-channel transistors having a bulk thereof connected to a source thereof.

* * * * *